United States Patent [19]

Horvath

[11] Patent Number: 4,963,932

[45] Date of Patent: Oct. 16, 1990

[54] MULTI-DOCUMENT EDITING

[75] Inventor: Jeno L. Horvath, Rochester, N.Y.

[73] Assignee: Xerox Corporation, Stamford, Conn.

[21] Appl. No.: 405,267

[22] Filed: Sep. 11, 1989

[51] Int. Cl.[5] ..... G03G 21/00

[52] U.S. Cl. ..... 355/218; 355/202

[58] Field of Search ..... 355/202, 201, 204, 208, 355/218, 40

[56] References Cited

U.S. PATENT DOCUMENTS

| | | | |
|---|---|---|---|
| 4,627,707 | 12/1986 | Tani et al. | 355/14 R |
| 4,720,729 | 1/1988 | Watanabe | 355/14 R |
| 4,734,789 | 3/1988 | Smith et al. | 358/300 |
| 4,777,510 | 10/1988 | Russel | 355/7 |
| 4,806,978 | 2/1989 | Nakatani et al. | 355/202 |

*Primary Examiner*—A. T. Grimley
*Assistant Examiner*—Nestor R. Ramirez
*Attorney, Agent, or Firm*—H. Fleischer; J. E. Beck; R. Zibelli

[57] ABSTRACT

A copy system in which at least one original document of a set of original documents is edited. An editing device associated with an electrophotographic printing machine edits the information in the selected original document and designates the page number of the original document selected for editing. Original documents are advanced sequentially from the set of original documents to the printing machine. The printing machine forms a set of copies corresponding to the set of original documents with the copy of the selected original document containing the edited information.

12 Claims, 6 Drawing Sheets

MULTI-DOCUMENT EDITING

This invention relates generally to a electrophotographic printing system and more particularly concerns an electrophotographic printing machine having associated therewith an information data editor.

Generally, an electrophotographic printing machine forms successive copies of an original document. Recent printing machines are also designed to reproduce an identical copy of the original document and an edited copy of the original document. Thus, the printing machine will erase unnecessary data on the original document and add new data thereto or identify selected text to be reproduced on the copy in a highlight color. In this way, the printing machine performs an information data editing function which significantly reduces the labor and time in preparing revised copies from an existing original document. In electrophotographic printing, a latent image is recorded on a photoconductive surface, developed, and the resultant powder image transferred to a copy sheet. The powder image is then fused to the copy sheet. The latent image of the original document is formed by scanning the original document and projecting a light image thereof onto the charged portion of the photoconductive surface so as to selectively discharge the charge thereon. The latent image is edited by superimposing thereover an electrically modulated beam, such as a modulated laser beam, or the like. The modulated laser beam adds additional information or erases information from the latent image. In this way, the resultant copy is altered from the original document. Various techniques have been devised for transmitting an electrical signal to modulate the laser so that the desired information recorded on the latent image. By way of example, the Panasonic E2S copier system uses an electronic pad to edit, move or delete information on a copy, and the Panasonic electronic print board allows information recorded on a blackboard sized electronic board to be copied automatically by a copying machine on a copy sheet. In order to define the area that is to be altered, the coordinates of the original document to be modified must be transmitted to the printing machine. Similarly, the NP 3525 Copier manufactured by the Canon Corporation employs an edit pad which enables selected portions of a copy to color highlighted or deleted. Digitizers may be employed to define the coordinates of the original document to be altered. Exemplary digitizers are described in U.S. Pat. Nos. 4,088,842; 3,904,822; 4,080,515; 4,243,843; 4,368,351; and 4,368,352. Thus, it feasible to employ a digitizer to define the coordinates of the original document to be altered or where additional information is to be inserted into the copy. One of the major problems of these editing systems is that only one document at a time can be edited and copied. It is highly advantageous to edit one or more documents of a multi-page document, and then reproduce the entire set of original documents with the edited information being incorporated into the appropriate copy. Various techniques have been devised for modifying copies of an original document. The following disclosures appear to be relevant:

U.S. Pat. No. 4,627,707, Patentee: Tani et al., Issued: Dec. 9, 1986.

U.S. Pat. No. 4,720,729, Patentee: Watanabe, Issued: Jan. 19, 1988.

U.S. Pat. No. 4,734,789, Patentee: Smith et al., Issued: Mar. 29, 1988.

U.S. Pat. No. 4,777,510, Patentee: Russel, Issued: Oct. 11, 1988.

Co-pending U.S. patent application Ser. No. 07/188,761, Applicant: Shenoy et al., Filed: Apr. 29, 1988.

The disclosures of the above-identified art may briefly summarized as follows:

U.S. Pat. No. 4,627,707 discloses a copier having an editing mode in which portions of a plurality of documents may be combined into a single composite document. Different colors are assigned to different areas of the composite document according to the order that area was input to the composite document.

U.S. Pat. No. 4,720,729 describes an image forming apparatus with an editing function for selectively erasing, enlarging, reducing or shifting any portion of an original image, and for forming an edited image in a color different from an unedited portion. One embodiment of the apparatus has a mode in which images from a plurality of originals may be edited in order to from a composite edited image. In this embodiment, a control key is provided which specifies a particular original to be placed on the original table for editing.

U.S. Pat. No. 4,734,789 and co-pending U.S. patent application Ser. No. 07/188,761 disclose an editing pad that defines the coordinates of an original document to be edited on a copy and enables the operator to add and/or delete information from the original on the copy. The editing device is associated with an electrophotographic printing machine and generates a signal indicative of the changes in the information on the original document. The signal is stored in an erasable read-only memory. The erasable read-only memory is inserted into the printing machine to control the formation of the copies so as to correspond to the edited original document.

U.S. Pat. No. 4,777,510 describes an apparatus for producing color accented reproductions of original documents in which an area to be color accented is highlighted. The apparatus is capable of reproducing multisheet document originals with portions thereof selectively erased or color accented. The areas to be selectively erased or color accented are indicated by highlighting the areas or by surrounding the areas with a line of highlight ink.

In accordance with one aspect of the present invention, there is provided a copy system, including input means for inputting an editing condition for image editing at least one original document of a set of original documents. Page designating means associated with the input means designates each original document edited by the input means in the set of original documents. Image forming means, installed in a copying machine, forms a copy image of each original document advanced thereto. Document moving means, associated with the copying machine moves each original document of the set of original documents to the image forming means. The image forming means forms a copy image of each original document of the set of original documents with the image forming means being responsive to the input means and the page designating means for forming a copy image of each original document edited in accordance with the editing condition from said input means.

Pursuant to another aspect of the present invention, there is provided a copying system for reproducing at least one set of copies from a set of original documents with at least one original document being selected for editing. The copying system includes an electrophotographic printing machine. Operator selectable means edits the information of the selected original document and designates the page number of that original document. The operator selectable means generates a signal indicative of the information edited in the selected original document and the page number of the original document selected for editing. Means advance sequentially successive original documents from the set of original documents to the electrophotographic printing machine. The electrophotographic printing machine reproduces a copy of each original document advanced thereto. The electrophotographic printing machine is responsive to the signal from the operator selectable means to edit the information of the selected original document so that each set of copies of the set of original documents contains an edited copy of the selected original document.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended cover all alternatives, modifications and equivalents as may be included within the spirit and scope of the invention as defined by the appended claims.

Figure 1:
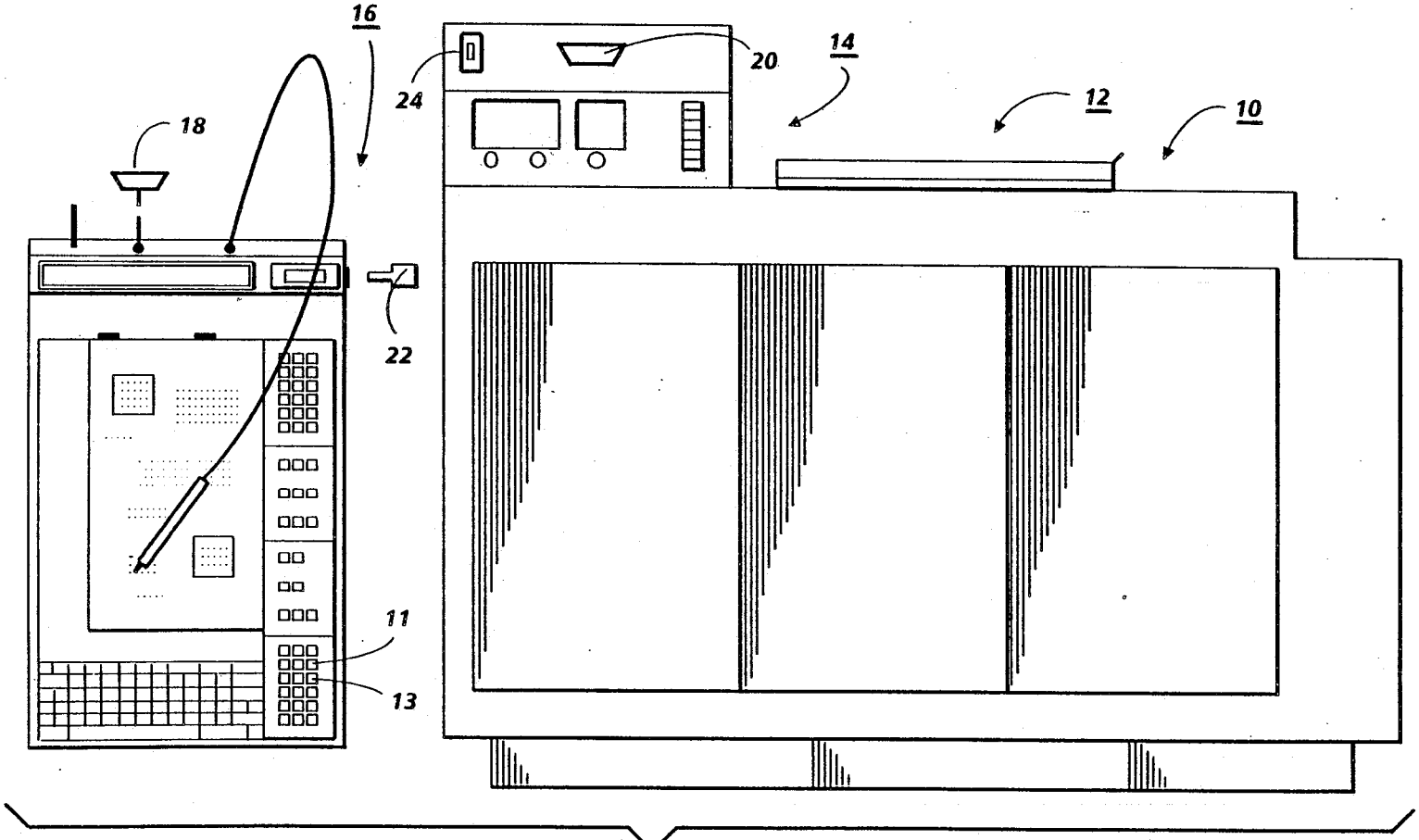
FIG. 1 is a schematic elevational view depicting an illustrative electrophotographic printing machine having the edit pad of the present invention associated therewith.

For a general understanding of the features of the present invention, reference is made to the drawings. In the drawings, like reference numerals have been used throughout to designate identical elements. FIG. 1 schematically depicts the printing system comprising an electrophotographic printing machine for reproducing copies and an edit pad for altering the copies without effecting the original document. It will become evident from the following discussions that the features of the present invention are not specifically limited in their application to the particular embodiment depicted herein.

Referring now to FIG. 1 of the drawings, the printing system and its operation will be described with reference thereto. Inasmuch as the art of electrophotographic printing is well known, the operation of the printing machine will be described briefly.

The electrophotographic printing machine, generally designated by the reference numeral 10, is capable of producing a stream of copy sheets having information copied on one side only, simplex sheets or on both sides, duplex sheets. A recirculating document feeder 12 is shown positioned above a platen at the imaging station of printing machine 10. Document feeder 12 is adapted to feed original documents, in seriatim, to the platen for copying. Document feeder 12 usually operates in a collating mode in which original documents are fed, in seriatim, from a stack in a tray at the top of the feeder to the platen for copying one at a time for each circulation and then returned to the stack. The original documents are placed in the feeder in a predetermined, page sequential order. For example, the first page is on top of the stack and the last page is at the bottom of the stack. The last original document is fed to the platen first and then returned to the top of the stack. Document feeder 12 sequentially feeds documents from a stack of documents placed by the operator face up in a normal forward collated order in the document stacking and holding tray. A document feeder located below the tray forwards the bottom document in the stack to a pair of take-away rollers. The bottom sheet is then fed by the rollers through a document guide to a feed roll pair and belt. The belt advances the document to the platen. After imaging, the original document is fed from the platen by the belt into a guide and feed roll pair. The document then advances into an inverter mechanism and back to the document stack through the feed roll pair. A position gate is provided to divert the document to the inverter or to the feed roll pair. Of course, one skilled in the art will appreciate that any suitable recirculating document feeder or automatic document feeder may be used and the features of the present invention are not limited to the type of document handling system used.

Imaging of a document is achieved by a scan lamp, lens and mirrors move across the original document illuminating successive incremental portions thereof. Light rays reflected from the document are transmitted through the lens. The lens focuses light images of the original document onto the charged portion of photoconductive belt to selectively dissipate the charge thereon. This records an electrostatic latent image on the photoconductive belt which corresponds to the informational areas contained within the original document.

The machine operator can control the operation of the printing machine and its related apparatus through the operator control panel, designated generally by the reference numeral 14, and the edit pad, designated generally by the reference numeral 16. Edit pad 16 is connected to the electrophotographic printing machine by an RS232 connector 18 which plugs into adapter 20 on control panel 14 of printing machine 10. If the edit pad is positioned remotely from printing machine 10, the changes in the copy are stored in a portable memory key 22 which is initially positioned in edit pad 16 to store the requisite changes. Thereafter, memory key 22 is inserted into the receptacle 24 in control panel 14 of printing machine 10 so as to control the printing machine to edit the copy, as required.

In general, electrophotographic printing machines include a belt having a photoconductive surface deposited on a conductive substrate. The belt advances successive portions of the photoconductive surface to various processing stations disposed about the path of movement thereof. Initially, a portion of the belt passes through a charging station. At the charging station, a corona generating device charges the photoconductive surface of the belt to a relatively high, substantially uniform potential. Thereafter, the charged portion of the photoconductive surface is advanced through the imaging station. At the imaging station, a scan lamp, lens and mirrors move across the original document illuminating successive incremental portions thereof. The light rays reflect from the original document are transmitted through the lens forming a light image thereof. These light rays are focused onto the charged portion of the photoconductive surface to selectively dissipate the charge thereon. This records an electrostatic latent image on the photoconductive surface which corresponds to the informational areas contained within the original document disposed upon the platen. If it is desired to erase selected portions of the original document or to add additional material thereto, a write system is actuated. A write system can either be a laser imaging system or an LED or LCD image bar When the laser system is used, it generates a modulated laser beam for selectively irradiating charged portions of the photoconductive surface to add additional information to the copy or to delete information therefrom. If it is desired to move information on the original document, the lens is automatically moved from its initial positional coordinates to the desired new positional coordinates as the optical system scans across the original document. In this way, information on the original document may be translated to new coordinates on the copy sheet. After the electrostatic latent image is recorded on the photoconductive surface, the belt advances it through a development station. At the development station, a magnetic brush development system transports a developer mixture of carrier granules and toner particles into contact with the electrostatic latent image recorded on the photoconductive surface. The toner particles are attracted from the carrier granules to the electrostatic latent image forming a toner powder image on the photoconductive surface of the belt. The development system includes at least two developer units. One of the developer units has black toner particles therein while the other developer unit includes toner particles of a selected color, e.g. red. In this way, the resultant copy may be reproduced in a desired color other than black or have portions thereof color highlighted. In either case, the toner particles are attracted from the carrier granules to the latent image forming a toner powder image on the photoconductive surface. After development, the belt advances the toner powder image to a transfer station. At the transfer station, a copy sheet is moved in contact with the toner powder image. A corona generating device sprays ions onto the backside of the copy sheet. This attracts the toner powder image from the photoconductive surface to the copy sheet. After transfer, the copy sheet moves to the fusing station. The fusing station includes a fuser assembly which permanently affixes the transferred toner powder image to the copy sheet. By way of example, the fuser assembly includes a heated fuser roll and back-up roll. The copy sheet passes between the fuser roll and back-up roll with the toner powder contacting the fuser roll. In this manner, the toner powder image is permanently affixed to the copy sheet. After fusing, a conveyor belt guides the advancing sheet to a catch tray or to a finishing station wherein a plurality of sets may be formed with the copy sheets being either stapled or bound to one another.

Edit pad 16 is designed to control editing of the copy sheet. If the edit pad is located remotely from the printing machine, the edited information is stored in memory key 22. Alternatively, if the edit pad 16 is connected by connector 18, i.e. an RS232 connector, to the printing machine, the altered information is transmitted directly to the printing machine so as to immediately modify copies being reproduced thereby. In operation, the original documents selected to be edited are sequentially placed on edit pad 16. Keys 11 and 13 are actuated, as required to designate the page number of the original documents being edited. The page number of the original documents being edited in shown on display 34. The alterations to the original document, i.e. editing, and the page number of the original document are either stored in key 22 or transmitted directly to the printing machine. After the selected original documents have been edited and the page numbers thereof designated, the set of original documents is rearranged in sequential order and placed in the recirculating document feeder 12. As successive original documents are advanced to the platen, the printing machine logic maintains a count of the number of original documents. At the appropriate number, the editing requirements stored in the printing machine for the particular original document alter the information from the original document so that the copy corresponds contains the edited information.

Figure 2:
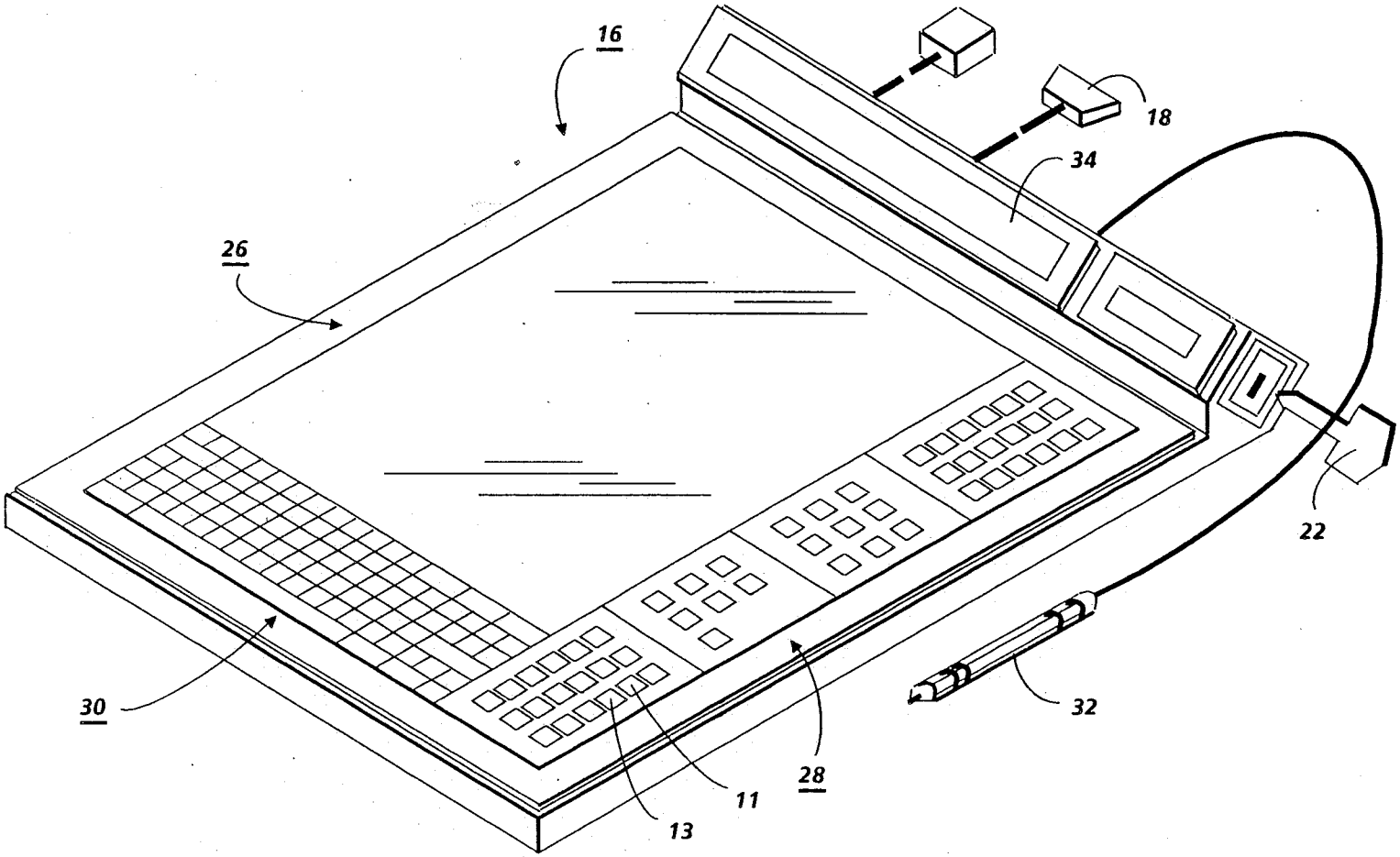
FIG. 2 is a perspective view of the FIG. 1 edit pad.

Referring now to FIG. 2, there is shown the detailed structure of edit pad 16. Edit pad 16 includes a digitizing area indicated generally by the reference numeral 26, an adjacent menu selection area, indicated generally by the reference numeral 28, and a keyboard area, indicated generally by the reference numeral 30. Menu selection area 28 has key 11 and 13 for designating the page numbers of the original documents being edited. The original document is positioned in the digitizing area and the coordinates of the original document desired to be altered are identified by positioning stylus 32 in contact therewith. Keys 11 and 13 are actuated as required to designate the page number of the original document positioned on digitizing area 26. In this way, positional coordinate information and the page number of the original document being edited is transmitted either directly to the printing machine through the RS232 channel, indicated by the reference numeral 18, or to memory key 22. In either case, any suitable digitizer may be employed. Suitable digitizing schemes are disclosed in U.S. Pat. Nos. 4,368,351; 4,368,352; and 4,243,843, the relevant portions thereof are hereby being incorporated into the present application. Menu selection area 28 includes a plurality of editing, and job programming features which may be actuated by locating the stylus 32 in contact with the selected block. Positioning the stylus 32 in contact with the selected block in menu selection area 28 defines the operation to be performed on the selected text within the original document. Alternatively, additional text may be furnished to the original document by selecting the appropriate block in the menu selection area and typing in the desired information by selecting the keys of keyboard area 30 with stylus 32. One skilled in the art will appreciate that a conventional typing keyboard may be employed in lieu of a keyboard area actuated by stylus 32. The information being added to the copy of the original document is displayed on display 34 which is a forty character, two line, liquid crystal display (LCD) for the exclusive purpose of illustrating the input data being added to the copy of the original document and the page number of the original document being edited. The LCD display is also programmed to provide step by step instructions for using the edit pad. Other suitable displays are cathode ray tubes (CRT). Memory key 22 is an erasable programmable, read only memory. By way of example, a 16K bit chip may be used to store the information to be used to program the operations of a remotely located printing machine. A card containing a chip may be used in lieu of a key.

Figure 3:
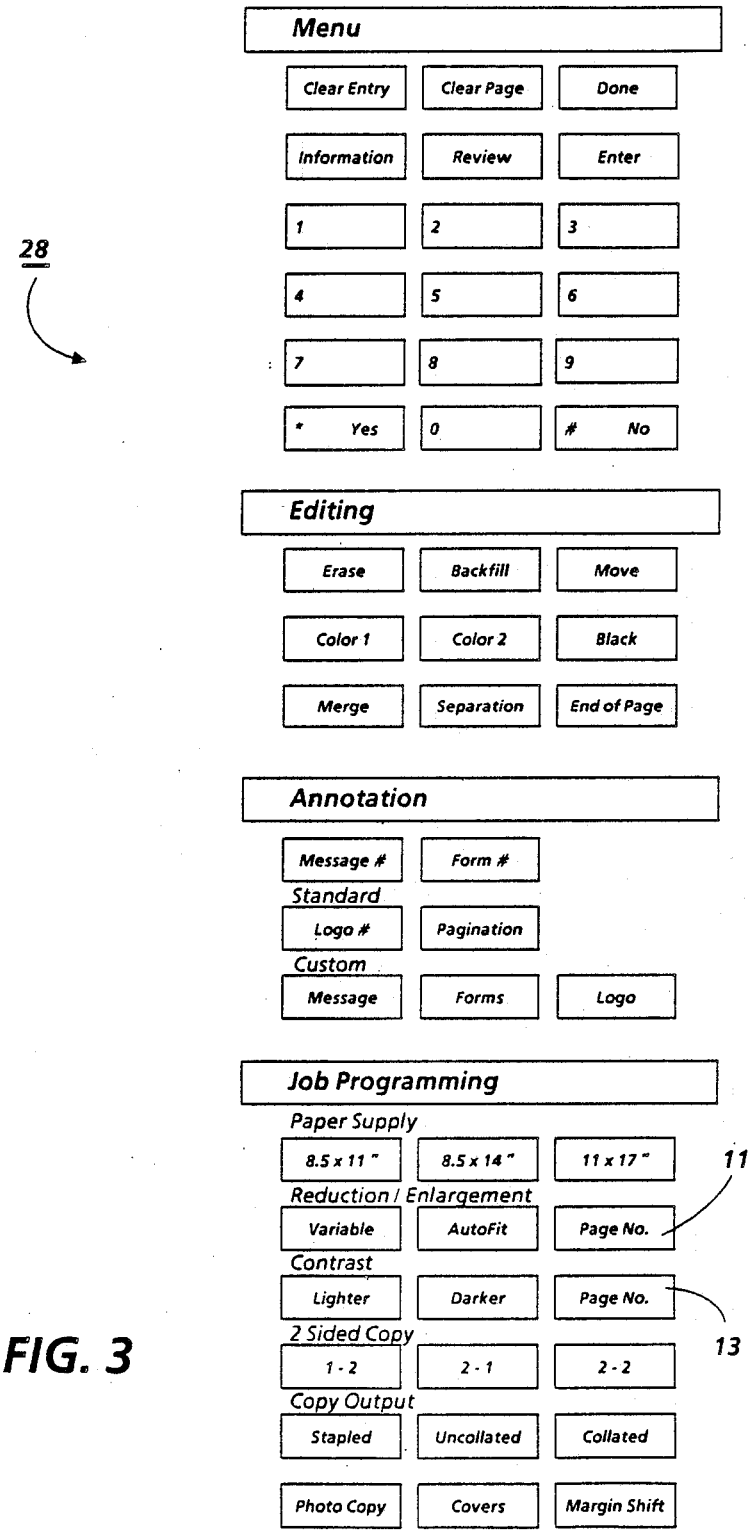
FIG. 3 shows the overlay view of the FIG. 2 edit pad.

Turning now to FIG. 3, there is shown the detailed structure of overlay menu area. 28. Menu area 28 includes 11 and 13 for designating the page number of the original document being edited. These keys may be blocks on the digitizing area actuated by the stylus or conventional keys actuated by the operator depressing the key. Each block of menu defines a specific operation to be performed on the copy. Each block is located in a discrete positional coordinate on the digitizing area. In this way, actuation of a specific block by stylus 32 defines specific positional coordinates which actuate the logic control to perform specific operations within the printing machine. By way of example, if it is desired to erase selected information from the copy sheet, the stylus is positioned in contact with the erase block of overlay menu 28. The digitizing area transmits a signal indicative of the erase positional coordinates. The information desired to be erased is selected and the positional coordinates thereof are also identified by the digitizing area. The digitizing area transmits a signal defining the positional coordinates of the information desired to be deleted from the copy and the operation to be performed on the copy, i.e. erase the information. This information along with the page number of the original document being edited is either stored in key 22 or transmitted directly to the printing machine. After all of the original documents in the set of original documents selected to be edited have been edited, the set of original documents is placed in recirculating document feeder 12. When the count of original documents advanced to the platen of the printing machine is coincident with the number of the original document selected to be edited, the erase signal actuates a light emitting diode array (LED) or the laser beam which is modulated to erase the selected portions of the original document from the copy sheet. This is achieved by illuminating selected portions of the electrostatic latent image after the latent image of the original document is recorded on the photoconductive surface. This deletes the desired information therefrom. If it were desired to move a selected block of text in the copy, the stylus would be positioned over the move block in overlay menu 28. This generates a signal which causes the control circuitry to move the lens to the new positional coordinates during the scan operation of the original document selected to be edited when that original document is positioned on the platen. In this way, the light image of the selected portion of the original document is shifted so as to shift a selected portion of the electrostatic latent image recorded on the photoconductive surface. In this way, the selected information on the original document is moved on the copy sheet to the new positional coordinates. Movement of the lens determines the inboard and outboard position of the information. In the process direction, latent image placement is delayed relevant to the position of the copy sheet. It is thus clear that by selecting various blocks on the overlay menu 28, the corresponding digitizing area positional coordinates transmit a signal which identifies the page number of the original document being edited and actuates the respective operations within the printing machine to effect the desired change on the copy sheet when that original document is positioned on the platen of the printing machine.

Figure 4:
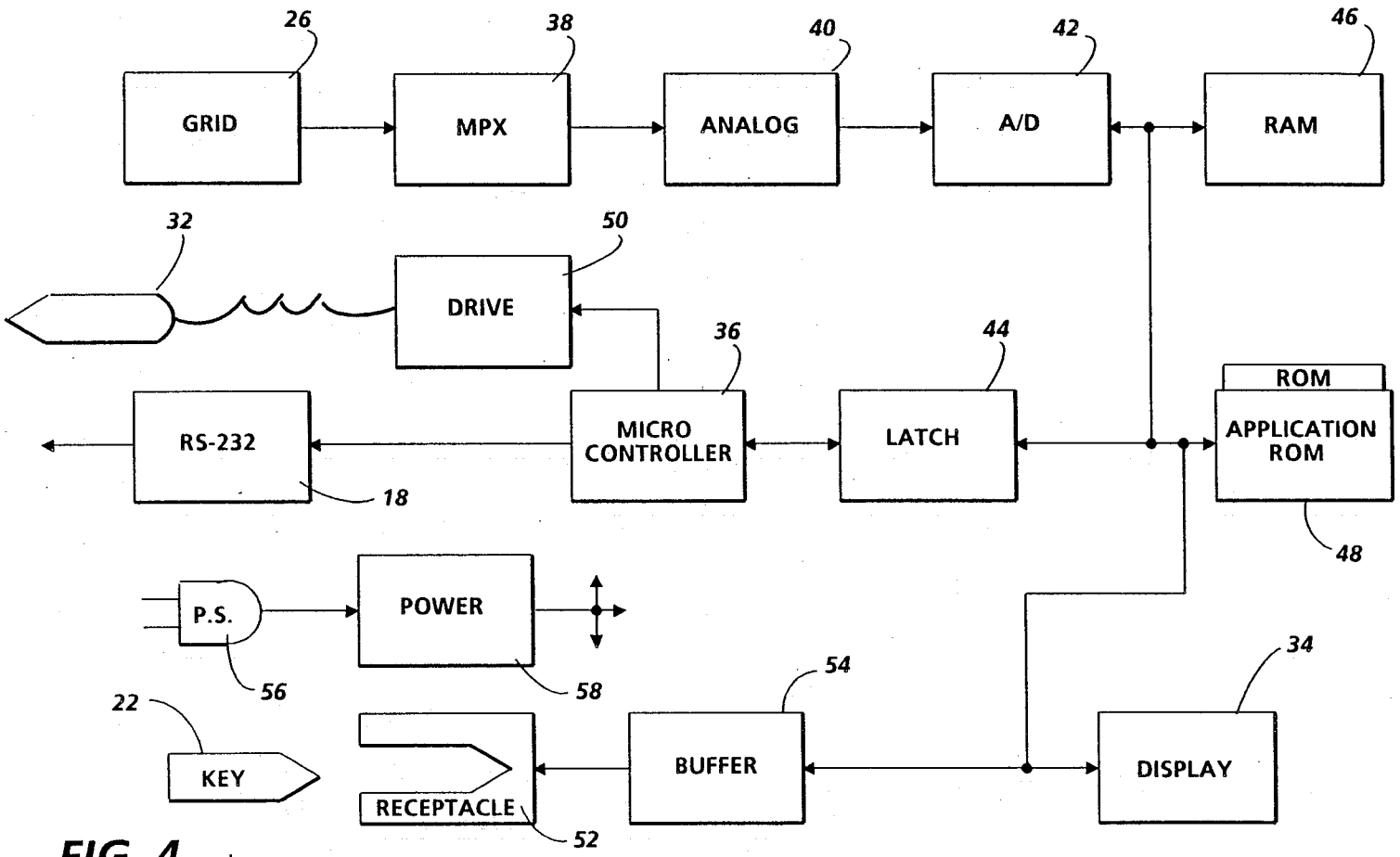
FIG. 4 is block diagram of the FIG. 2 edit pad.

Turning now to FIG. 4, there is shown a block diagram of the electronics package being employed. An Intel 8051/8031 microcontroller chip 36 forms the basic electronics control package. Microcontroller chip 36 receives information from digitizing area 26. This information is transmitted through a multiplexing circuit 38, an analog circuit 40, and an analog to digital circuit 42 and a latching circuit 44. The output from the analog to digital converter is also transmitted to a random access memory chip 46. Software to interpret the coordinates and run the digitizer reside in read only memory chip 48. The digitizing area 26 output is also connected to display 34. Microcontroller 36 controls drive circuit 50 which is coupled to stylus 32. Memory key 22 is received in receptacle 52 which is connected to display 34 and microcontroller 36 via buffer 54. Power supply 56 connects power supply 58 to an external power source. Microcontroller 36 obtains positional data from the digitizing areas, formats the data for transmission, and places the data into the memory key 22 or transmits the data by the RS232 channel 18 to printing machine 10. It is also controls the data bus line and several peripherals, i.e. display 34, analog to digital converter 42, non-volatile memory key receptacle 52, programmable read only memory 48, and random access memory 46. Analog to digital converter 42 connects analog circuit 40 supporting the digitizing area 26 and provides raw digital positional information to microcontroller 36. Key receptacle 52 forms a physical socket for the non-volatile memory key 22 and connects it electrically to the controller bus line. There is no need for buffer 54 located between the data bus line and the key receptacle if the edit pad is non-operative when the key is removed. However, if the edit pad operates with or without the key, line buffering is required and buffer 54 is necessary. External application read only memory 48 and random access memory 46 each preferably have 4K of memory.

Figure 5:
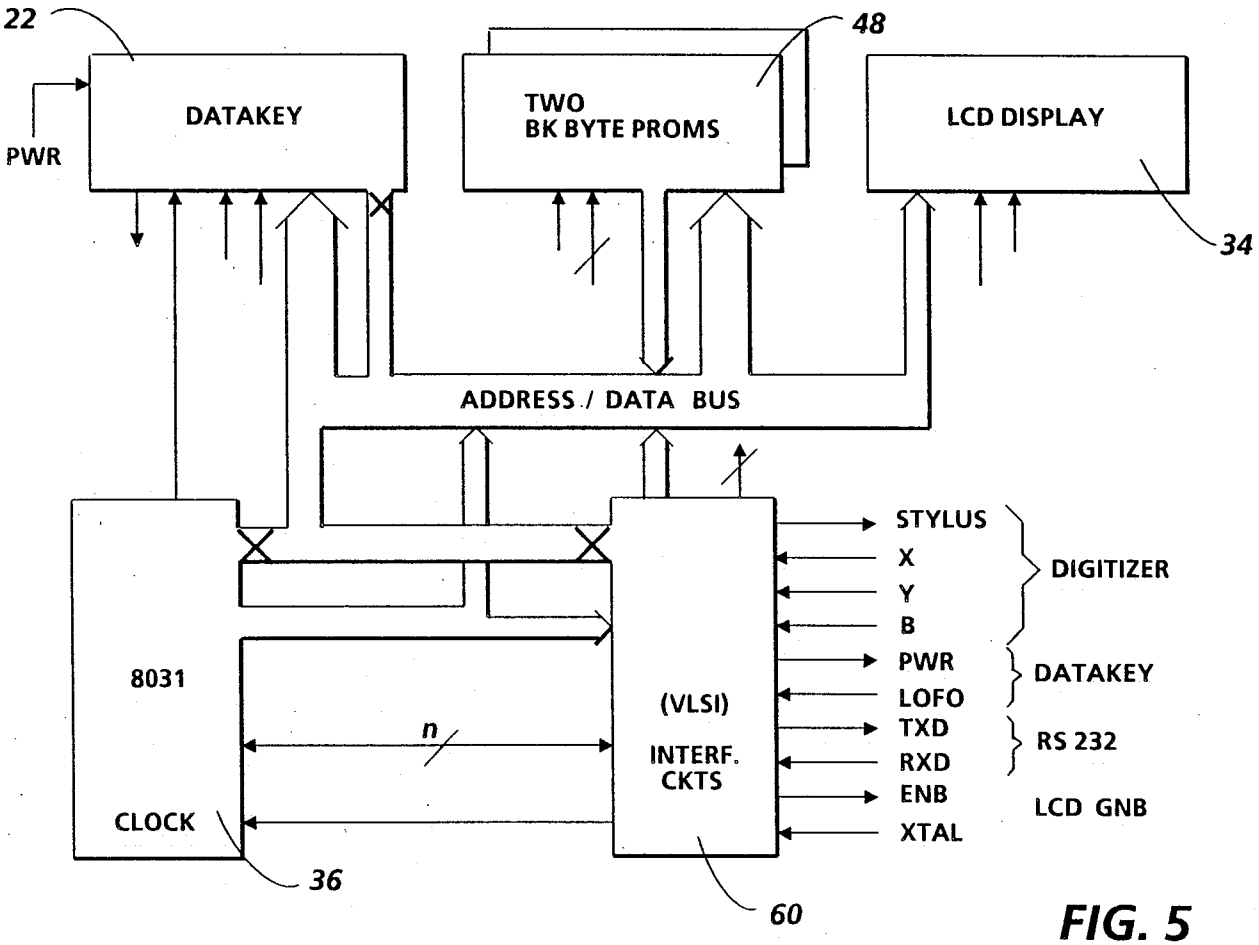
FIG. 5 is a logic diagram illustrating the logic circuitry employed in the FIG. 3 edit pad.

Referring now to FIG. 5, there is shown another block diagram of edit pad 16. As shown thereat, data key 22, read only memory 48, and display 34 are connected to microcontroller 36, which, in turn, is connected to interface logic circuit 60 which controls printing machine 10. By way of example, interface circuit 60 may be a VLSI chip. The logic diagram for interface circuit 60 is shown in FIG. 6.

Figure 6:
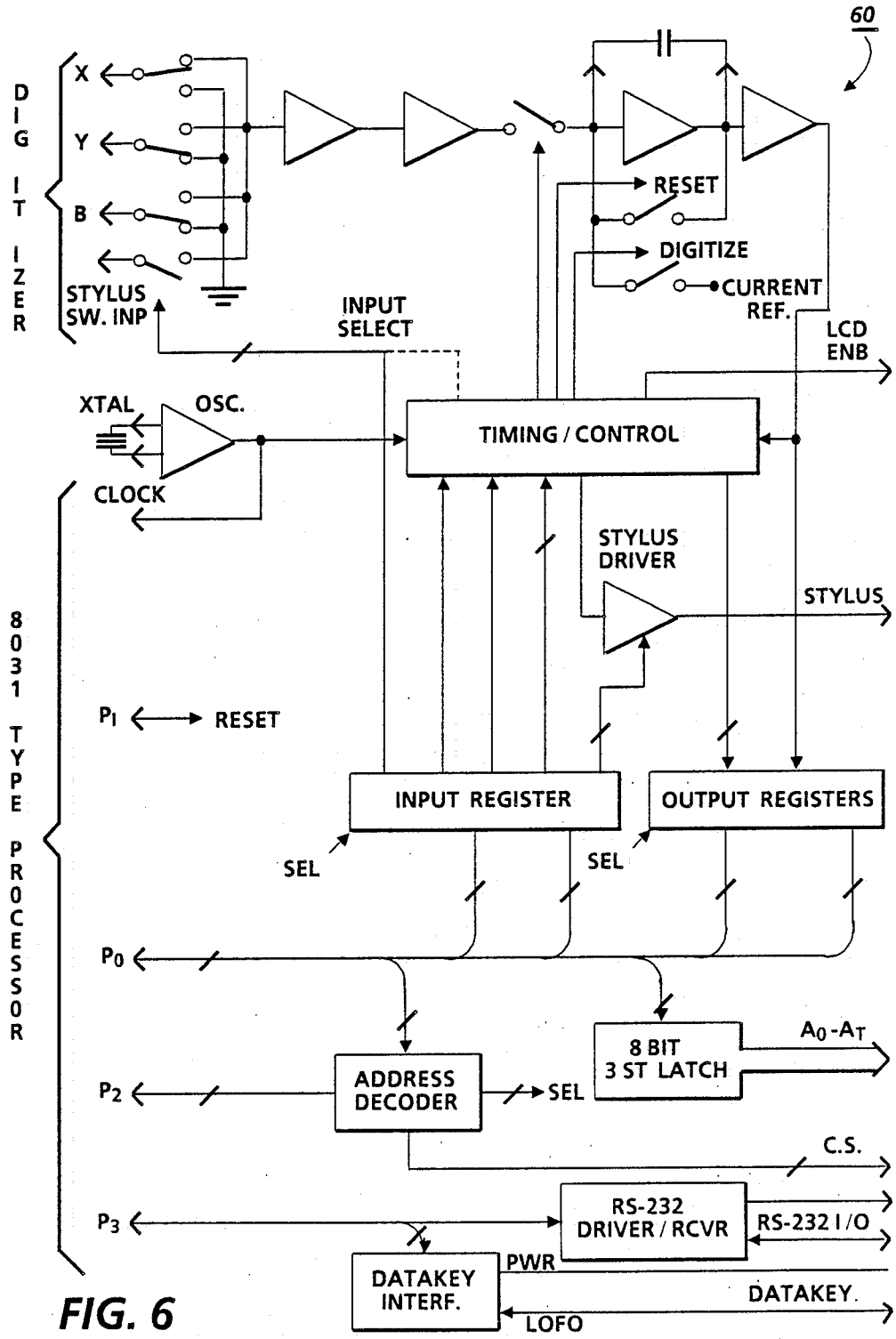
FIG. 6 is a logic diagram of the FIG. 5 VLSI circuitry.

As shown in FIG. 6, interface logic circuit 60 is connected to the digitizing area 26 and microcontroller 36. It is also connected to memory key 22, RS232, connector 18 and liquid crystal display 34. One skilled in the art will appreciated that interface circuit 60 is one embodiment and there may be many alternatives and variations which achieve the same functions. Interface circuit 60 is designed to generate the requisite signals to control the printing machine so that the information reproduced on the copy sheet contains the desired alterations from the original document.

The edit pad described herein is disclosed in U.S. Pat. No. 4,734,789 issued to Smith et al. on Mar. 29, 1988 and co-pending U.S. patent application Ser. No. 07/188,761 filed by Shenoy et al. on Apr. 29, 1988 now a U.S. Pat. No. 4,887,129, exclusive of the page designating keys and method of reproducing selected edited original documents from a set of original documents being advanced to the platen of the printing machine by the recirculating document feeder. The relevant portions of the foregoing are hereby incorporated into the present application by reference thereto.

In recapitulation, it is clear that the edit pad of the present invention either stores the information necessary for altering the copy sheet from the original document and the page number of the original document being edited or transmits this information directly to the printing machine. After all of the original documents selected to be edited in the set have been edited on the edit pad and their page numbers designated, the set of original documents is positioned in the recirculating document feeder associated with the electrophotographic printing machine. Successive original documents are sequentially advanced from the stack of original documents to the platen of the printing machine. When the document count is coincident with the page number, the electrophotographic printing machine alters the copy to correspond with the edited information transmitted thereto from the edit pad.

It is, therefore, evident that there has been provided in accordance with the present invention, a printing system which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

I claim:

1. A copy system, including:

input means for inputting an editing condition for image editing at least one original document of a set of original documents;

page designating means associated with said input means for designating each original document edited by said input means in the set of original documents;

a copying machine;

image forming means installed in said copying machine for forming a copy image of each original document advanced thereto; and document moving means associated with said copying machine for moving each original document of the set of original documents to said image forming means, said image forming means forming a copy image of each original document of the set of original documents with said image forming means being responsive to said input means and said page designating means for forming a copy image of each original document edited in accordance with the editing condition from said input means.

2. A copy system according to claim 1, wherein said input means is installed in said copying machine.

3. A copy system according to claim 1, further including:

a storage medium, attachably/detachably attached to said input means, for storing the inputted editing condition and the page designation of each original document edited in accordance with the editing condition from said input means; and a storage medium receiving portion formed on said copying machine to which said storage medium being attachably/detachably attached.

4. A copy system according to claim 3, wherein said storage medium includes a readable/writable memory.

5. A copy system according to claim 1, wherein said input means includes:

a tablet on which each original document to be edited is placed; and an input pen for designating a position to be edited on the original document by contacting said tablet.

6. A copy system according to claim 1, wherein:

said input means includes editing function designating means for selectively designating at least one of a plurality of editing functions; and said image forming means includes means for editing an image in accordance with the designated editing functions from said editing function designating means.

7. A copying system for reproducing at least one set of copies from a set original documents with at least one original document being selected for editing, including:

an electrophotographic printing machine;

operator selectable means for editing the information of the selected original document and designating the page number of the original document selected for editing, said operator selectable means generating a signal indicative of the information edited in the selected original document and the page number of the original document selected for editing; and means for advancing sequentially successive original documents from the set of original documents to said electrophotographic printing machine, said electrophotographic printing machine reproducing a copy of each original document advanced thereto with said electrophotographic printing machine being responsive to the signal from said operator selectable means to edit the information of the selected original document so that each set of copies of the set of original documents contains an edited copy of the selected original document.

8. A copying system according to claim 7, wherein said operator selectable means is installed in said electrophotographic printing machine.

9. A copying system according to claim 7, further including means, mounted removably on said operator selectable means, for storing the signal indicative of the information to be edited and the page number of the original document selected to be edited, said storing means being adapted to be mounted removably on said electrophotographic printing machine to transmit the edited information and page number of the original document selected to be edited to said electrophotographic printing machine.

10. A copying system according to claim 7, further including operator connectable means for connecting said operator selectable means to said electrophotographic printing machine to transmit the signal from said operator selectable means to said electrophotographic printing machine.

11. A copying system according to claim 7, wherein said operator selectable means includes:

a digitizing area adapted to have the original document positioned thereon; and an operator movable stylus operatively associated with said digitizing area to energize operator selected regions of said digitizing area to generate a signal defining the positional coordinates of the original document to be altered.

12. A copying system according to claim 11, wherein said operator selectable means includes operator actuatable command input means for entering commands defining the operation to be performed on the original document to edit the information thereof.

* * * * *